US012583654B1

(12) United States Patent
Winthrop

(10) Patent No.: US 12,583,654 B1
(45) Date of Patent: Mar. 24, 2026

(54) LUNCH BOX WITH AN INTERNAL CASE WITH A DRY ERASE PANEL

(71) Applicant: Lindsie Winthrop, Shoreline, WA (US)

(72) Inventor: Lindsie Winthrop, Shoreline, WA (US)

( * ) Notice: Subject to any disclaimer, the term of this patent is extended or adjusted under 35 U.S.C. 154(b) by 193 days.

(21) Appl. No.: 18/400,935

(22) Filed: Dec. 29, 2023

Related U.S. Application Data

(60) Provisional application No. 63/463,689, filed on May 3, 2023.

(51) Int. Cl.

| | |
|---|---|
| ***A45C 11/20*** | (2006.01) |
| ***A45C 13/02*** | (2006.01) |
| ***A45C 15/02*** | (2006.01) |
| ***B65D 25/04*** | (2006.01) |
| ***B65D 43/16*** | (2006.01) |
| ***B65D 43/22*** | (2006.01) |
| ***B65D 51/24*** | (2006.01) |
| ***B65D 51/28*** | (2006.01) |

(52) U.S. Cl.
CPC ..... *B65D 51/245* (2013.01); *A45C 11/20* (2013.01); *A45C 13/02* (2013.01); *A45C 15/02* (2013.01); *B65D 25/04* (2013.01); *B65D 43/163* (2013.01); *B65D 43/22* (2013.01); *B65D 51/28* (2013.01); *A45C 2200/10* (2013.01); *B65D 2543/00194* (2013.01)

(58) Field of Classification Search
CPC ..... B65D 51/245; A45C 11/20; A45C 13/02; A45C 13/03; A45C 2011/007; A47K 10/32; A47K 2010/3266
USPC ..... 206/233
See application file for complete search history.

(56) References Cited

U.S. PATENT DOCUMENTS 1,867,455 A * 7/1932 Humphrey ..... B65D 25/105 190/110
3,777,418 A * 12/1973 Cooper ..... A45C 11/20 206/542
5,396,999 A * 3/1995 Sandheinrich ..... A45C 13/08 206/541
5,699,925 A * 12/1997 Petruzzi ..... B65D 21/0204 206/508
5,718,336 A * 2/1998 Haarlander ..... A45C 13/08 206/541

(Continued)

FOREIGN PATENT DOCUMENTS

CN 2933099 Y 8/2007
GB 2505181 A 8/2012

*Primary Examiner* — Ernesto A Grano
(74) *Attorney, Agent, or Firm* — John Rizvi; John Rizvi, P.A.—The Patent Professor®

(57) ABSTRACT

The present invention introduces an advanced meal transporting assembly, combining the functionality of a traditional lunch box with innovative features. Constructed from diverse materials like molded plastic, tin metal, or insulated fabric, the container includes a base with compartment dividers for organized food storage. A distinctive element is the internal storage unit, resistant to moisture, with a writable surface and a transparent, hermetically sealing lid. This feature allows for safe storage of notes or drawings, enhancing the utility of the lunch box. The assembly is secured with a clasp, ensuring safe transport. This novel design caters to the needs of users who require both meal transportation and a secure, dry space for notes, offering a practical solution for daily use.

20 Claims, 5 Drawing Sheets

(56) References Cited

U.S. PATENT DOCUMENTS 5,950,834 A * 9/1999 Woodnorth ..... B65D 43/162 206/541
6,144,016 A * 11/2000 Garvin ..... F24C 7/10 220/523
6,234,677 B1 * 5/2001 Mogil ..... A45C 13/02 383/110
6,305,547 B1 * 10/2001 Curran ..... A45C 11/20 206/541
6,347,706 B1 * 2/2002 D'Ambrosio ..... A45C 11/20 206/541
6,582,124 B2 * 6/2003 Mogil ..... A45C 7/0077 383/110
D476,480 S * 7/2003 Hillman ..... D3/273
6,609,942 B1 * 8/2003 Cole ..... A63H 33/38 206/542
6,702,375 B1 * 3/2004 Laskowski ..... B60R 7/043 297/283.1
6,821,019 B2 * 11/2004 Mogil ..... A45C 13/02 383/110
6,981,593 B1 * 1/2006 Klodt ..... A45C 13/02 206/541
7,073,462 B1 * 7/2006 Layman ..... A01K 27/008 119/867
7,828,138 B2 * 11/2010 Stukenkemper ..... A45C 11/36 206/214
7,905,038 B2 * 3/2011 Coff ..... A47J 41/00 40/307
8,002,115 B2 * 8/2011 Rappaport ..... A45C 15/00 150/112
8,043,004 B2 * 10/2011 Mogil ..... A45C 5/02 220/592.2
8,113,381 B2 * 2/2012 Che ..... B65H 35/10 206/390
8,590,726 B1 * 11/2013 Mickelson ..... B65D 25/2844 220/763
8,863,546 B2 * 10/2014 Oberweis ..... F25D 3/14 62/441
9,314,075 B2 * 4/2016 Sparks ..... A45C 3/00
D811,825 S * 3/2018 Neumann ..... A45C 11/20 D7/629
D831,445 S * 10/2018 Karger ..... D7/703
D836,682 S * 12/2018 McCurry ..... D15/79
10,349,740 B2 * 7/2019 Olson ..... E05D 7/1077
D858,227 S * 9/2019 Wiles ..... D7/709
10,426,241 B2 * 10/2019 Nash ..... A45F 3/46
10,473,390 B2 * 11/2019 McCurry ..... F25D 31/005
10,618,692 B2 * 4/2020 Hori ..... B65D 25/04
D911,792 S * 3/2021 Candela ..... D7/709
D949,637 S * 4/2022 Earle ..... D7/703
12,246,894 B1 * 3/2025 Rodriguez, Jr. ..... B65D 51/245
2004/0031720 A1 2/2004 Simpson
2007/0020444 A1 * 1/2007 Moore ..... B43L 1/045 428/195.1
2008/0121630 A1 * 5/2008 Simard ..... A45C 11/20 220/592.2
2008/0156815 A1 * 7/2008 Coff ..... A47J 41/00 220/592.2
2008/0245793 A1 * 10/2008 Hanson ..... A45C 11/20 220/592.2
2010/0236974 A1 9/2010 Pedrazzi et al.
2010/0258576 A1 * 10/2010 Marquez ..... A45C 11/20 220/737
2010/0263399 A1 * 10/2010 Pollina ..... F25D 3/08 62/331
2010/0308039 A1 * 12/2010 Miros ..... B65D 45/16 220/553
2013/0043285 A1 * 2/2013 Cordray ..... A45C 15/00 224/148.3
2013/0101979 A1 * 4/2013 Shanbour, II ..... B43L 1/004 434/408
2013/0119850 A1 * 5/2013 Breyburg ..... A47B 57/08 312/348.3
2016/0120162 A1 * 5/2016 Copper ..... A45C 11/20 220/592.2
2016/0355319 A1 * 12/2016 Stephens ..... A45C 13/126
2017/0008688 A1 * 1/2017 Barattin ..... A45C 7/0077
2018/0141739 A1 * 5/2018 Hengen ..... B65D 81/3813
2019/0144164 A1 * 5/2019 Breyburg ..... B65D 25/14 220/495.01
2019/0254400 A1 * 8/2019 Challa ..... A45F 3/04

* cited by examiner

LUNCH BOX WITH AN INTERNAL CASE WITH A DRY ERASE PANEL

CROSS-REFERENCE TO RELATED APPLICATIONS

This application claims the benefit of U.S. Provisional Patent Application 63/463,689 filed on May 3, 2023, which is incorporated by reference herein in its entirety.

FIELD OF THE INVENTION

The present invention relates generally lunch boxes and more particularly to lunch boxes with internal storing cases for notes and kits for retrofitting existing lunch boxes into lunch boxes comprising internal storing cases for notes.

BACKGROUND OF THE INVENTION

Over the past two hundred years, countless midday meal transporting devices have evolved comprising many useful and creative features, depending on the purpose of the container and other diverse factors ranging from the age and occupation of its user to fashion statements, just to name a few. Lunch boxes, also known as lunch pails, lunch buckets, or lunch tins, are containers that are generally used to carry food, e.g., to school or work. They are commonly made of a suitable material such as metal or hard plastic, or even soft insulated polyester fabrics with zippers, and are for the most part temperature insulating and airtight. Some lunch boxes accommodate ice packs to help maintain the food at a cold temperature. Others comprise subdivisions for separate storage of different foods such as the bento style modern lunch boxes. Generally, lunch boxes comprise a clasp or similar interlocking fastening mechanism for maintaining a closed configuration, and a hand handle for carrying them.

The origins of the common modern lunch box can be traced to the mid-1800s when people began adapting tobacco tins to carry their lunch. As industrialization increased, most people started working away from home and it became impractical to return home for lunch daily, so more and more workers started carrying lunch boxes with them to work. These early lunch boxes were mainly heavy-duty pails made of metal to protect the workers' food from the perils of the workplace. For example, if a worker was bringing a sandwich to the quarry or a coal mine, a paper bag would not fare well.

Around the 1880s, school children began to emulate their parents and they too began carrying lunch boxes to school. When it became possible to lithograph images on the metallic surfaces of tin boxes in the early 1900s, the decorated containers became commercially successful products and a staple of school-aged children nationwide.

Tin metal dominated the lunch box market for generations. When television became popular in the 1950s, manufacturers realized that they could sell more of these practically indestructible metal lunch boxes if they printed iconic characters of fleeing popularity on them. That way children would want a new lunch box as trends changed and as they aged to make a personal statement with each new school year. A child lunch box was a means of expression. For example, a youngster sporting a lunch box decorated with superhero characters from comic books was in essence sending the message during recess: "Hey, I'm into comic books. Do you want to be friends?"

However, in the 1990s, plastic molding popularized the use of hard plastic lunch boxes that were cheaper to mass produce. Eventually, insulted soft polyester fabric lunch boxes with zippers to open/close their lids also gained popularity.

Very often, a parent, spouse, or significant other packs a person's lunch for them, especially for school children. It is also often the case that the person packing the lunch for others wants to place a note in the lunch box with, for example, a positive thought or a reminder. Most people, especially children, can agree that their lunch break, which is a crucial part of their busy day to reset their minds and nourish their bodies, is significantly improved when they find a special note or memo from a loved one, like their mother, in their lunch box. The message in the note may be an inspirational thought, or an expression of love, but it may also be an important reminder, for example, of an appointment or another commitment. In some instances, the note may be a self-reminder for those who pack their own lunch.

Unfortunately, current commercially available lunch boxes often gather moisture inside, especially when storing cold food, and/or when a food container accidentally leaks liquid contents, and the paper notes get soggy to the point where the message becomes unreadable. In addition, the note may get mixed in with other items inside the lunch box or may be accidentally dropped and not be found and read by the intended recipient.

It would be extremely useful for consumers to have lunch boxes in which their paper notes are kept away from moisture and are easy to find so that the messages on them can be read by the intended recipient.

Accordingly, there remains a need in the art for a solution to at least one of the aforementioned problems, such lunch boxes in which notes can be easily found and maintained dried.

SUMMARY OF THE INVENTION

The present invention pertains to an innovative meal transporting assembly, specifically a lunch box equipped with advanced features for enhanced utility and convenience. This lunch box is designed with a base that includes a storage compartment suitable for holding various contents, and an opening for the easy placement and retrieval of these contents. Uniquely, the lunch box is enhanced by the inclusion of a waterproof storing case, which is strategically positioned on the internal surface of the lunch box's lid. This storing case is not only waterproof but also features a dry erase back panel within its base, alongside an internal cavity for the secure storage of paper notes. To ensure the protection and dryness of the contents within, the waterproof storing case is equipped with a hingeably attached lid and an interlocking fastening mechanism. This mechanism is crucial for maintaining a hermetic seal, thereby keeping the internal storage cavity free from moisture. Additionally, the lunch box is designed with a clasp for secure closure. This invention is particularly significant as it not only serves the primary function of transporting meals but also offers an innovative solution for storing notes in a moisture-free environment, making it an ideal choice for a variety of users. The invention further encompasses kits for retrofitting existing lunch boxes to include these advanced features, thereby extending the utility and lifespan of conventional lunch boxes.

The present invention introduces significant advancements in the realm of meal transporting assemblies, offering multiple benefits over traditional lunch box designs. A key advantage is the incorporation of a waterproof storing case within the lunch box's lid, which is not commonly found in conventional lunch boxes. This case, equipped with a hermetically sealing lid and an interlocking fastening mechanism, ensures that paper notes and other items are kept dry and secure, addressing a common issue of moisture damage often encountered in typical lunch box environments. Additionally, the dry erase back panel within the storing case's base adds an element of reusability and convenience for note-taking, a feature that elevates the functionality of the lunch box beyond mere food transportation. The innovative design of the base and lid of the lunch box, hingeably coupled for ease of access while ensuring the contents are securely enclosed, further distinguishes this invention. These enhancements not only extend the utility of the lunch box but also provide a versatile solution that adapts to the diverse needs of users, ranging from students to professionals. Furthermore, the invention's adaptability is showcased through the provision of retrofitting kits, enabling the upgrade of existing lunch boxes with these novel features, thereby offering a cost-effective and sustainable option for consumers seeking to upgrade their meal transporting solutions.

In a first implementation of the invention, a meal transporting assembly comprises:

- a container suitable for carrying food items, including a base portion having a storage area for accommodating various items and an access opening;
- a closure mechanism associated with the container, operable to selectively open and close the access opening;
- a storage unit located within the container, designed to be resistant to environmental conditions, such as moisture;
- the storage unit including a base with a writable surface and an internal compartment for holding items such as notes or other materials;
- the storage unit further comprising a closure element, which can be opened and closed, and a sealing mechanism to protect the internal compartment from external elements; and
- a securing means for maintaining the closure of the container.

In a second aspect, the container may be made from a material selected from the group consisting of molded plastic, tin metal, treated wood, insulated polyester fabric, natural fibers, and woven bamboo.

In another aspect, the base portion of the container may further comprise compartment dividers to create subdivisions for different food types.

In another aspect, the closure element of the storage unit may be hingeably coupled to the base of the storage unit and is configured to hermetically snap close and open.

In another aspect, the closure element of the storage unit may be made from a transparent material.

In another aspect, the base of the storage unit may comprise a writable surface forming a cavity for storing items such as paper notes.

In another aspect, the cavity may have a depth sufficient to prevent the closure element from contacting the writable surface.

In another aspect, the storage unit may be disposed on the internal surface of the closure mechanism of the container.

In another aspect, the storage unit may be removable and configured to snap into a designated place within the container.

In another aspect, the meal transporting assembly may further comprise a kit for retrofitting existing containers to include a storage unit similar to the storage unit of the meal transporting assembly.

In another aspect, the kit may include instructions for the placement of the storage unit within the container.

In another aspect, the kit may include sticky paper notes that fit inside the internal compartment of the storage unit.

In another aspect, the sticky paper notes may be of different bright colors and may include pre-written positive notes or quotes.

In another aspect, the storage unit may include an adhesive on its back for permanent attachment inside the container.

In another aspect, the placement and orientation of the storage unit within the container are configured to prevent interference with the opening and closing of the container.

In another aspect, the container includes a fastening mechanism such as the securing means to maintain the container in a closed configuration.

In another aspect, the container is constructed in a style with subdivisions for different types of food products.

In another aspect, the storage unit is dimensioned to fit within the container without affecting its opening/closing functions.

In another implementation of the invention, the meal transporting assembly comprises: a container suitable for carrying food items, fabricated from a material selected from the group consisting of molded plastic, tin metal, treated wood, insulated polyester fabric, natural fibers, and woven bamboo, and featuring a foldable fastening clasp for secure closure; a base portion of the container including bento-style compartment dividers for organizing different food types; a storage unit located within the container, designed to be resistant to environmental conditions, such as moisture, removable, and configured to snap into a designated place within the container, with an adhesive back for permanent attachment in a highly visible location upon opening the container's lid; the storage unit including a base with a writable surface, specifically a dry erase back panel, and forming a shallow cavity sufficient to prevent the transparent closure element from contacting the writable surface, thereby allowing for the storage of paper notes without interference; the storage unit further comprising a transparent closure element, hingeably coupled to the base of the storage unit, configured to hermetically snap close and open, and made from a material that facilitates easy viewing of any notes or materials stored within; the placement and orientation of the storage unit within the container configured to prevent interference with the opening and closing of the container; and the meal transporting assembly further includes a kit with sticky paper notes of different bright colors and pre-written positive notes or quotes, fitting inside the internal compartment of the storage unit.

In another implementation of the invention, a method of using a meal transporting assembly comprises the steps of:

- providing a meal transporting assembly, comprising:
  - a container suitable for carrying food items, fabricated from a material such as molded plastic, tin metal, treated wood, insulated polyester fabric, natural fibers, or woven bamboo, and equipped with a base portion having compartment dividers for organizing different food types;
  - a storage unit within the container, resistant to environmental conditions such as moisture, including a base with a writable surface and a transparent closure element;
- placing various food items into the subdivided compartments of the base portion of the container;

writing notes, memos, or drawings on the writable surface of the storage unit's base using a suitable writing instrument, such as a dry erase marker;

placing paper notes or other materials into the storage unit's cavity, if desired;

closing the transparent closure element of the storage unit to hermetically seal and protect the contents within from environmental conditions;

closing the container using a securing means, such as a clasp, to maintain the contents in a secured and organized manner during transport; and opening the container and the storage unit as needed to access the food items and the contents of the storage unit, respectively.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings, which are incorporated into and form a part of the specification and together with the description, are provided to illustrate and not to limit the invention, where like designations denote like elements, and in which.

Like reference numerals refer to like parts throughout the several views of the drawings.

DETAILED DESCRIPTION

Figure 1:
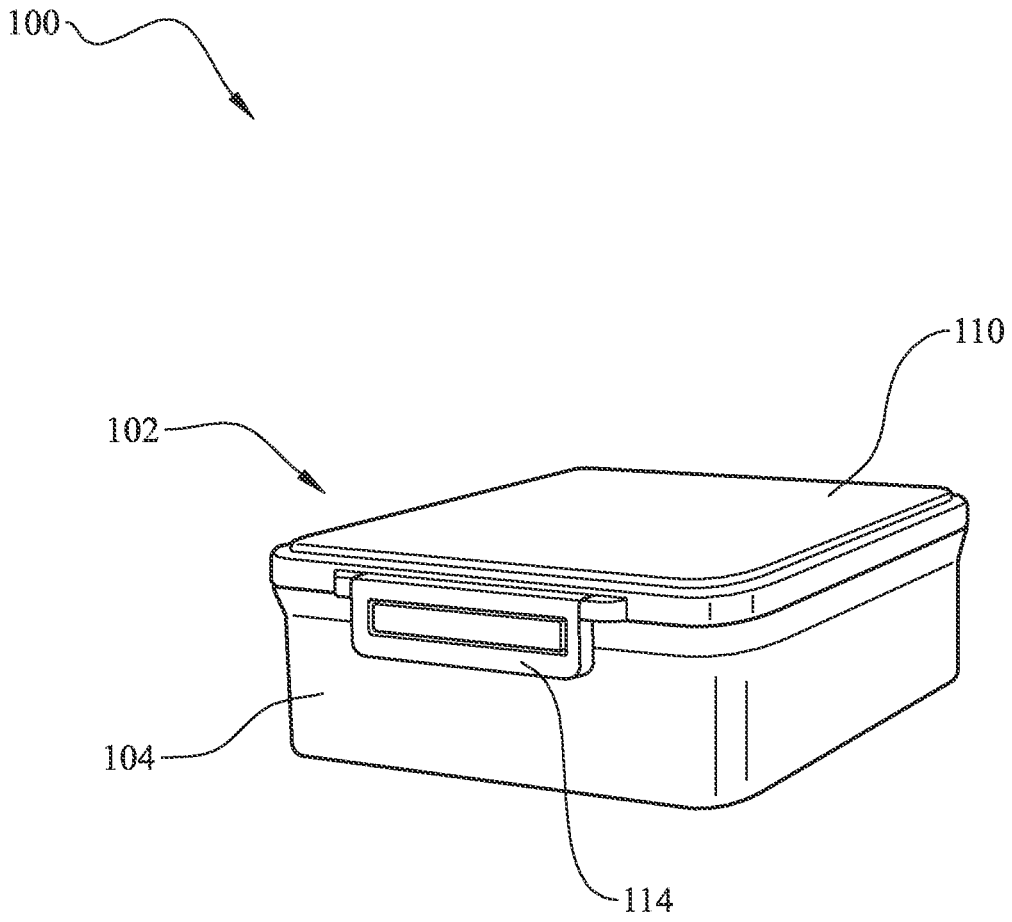
FIG. 1 presents an isometric perspective view of an embodiment of the invention for a lunch box assembly.
Figure 2:
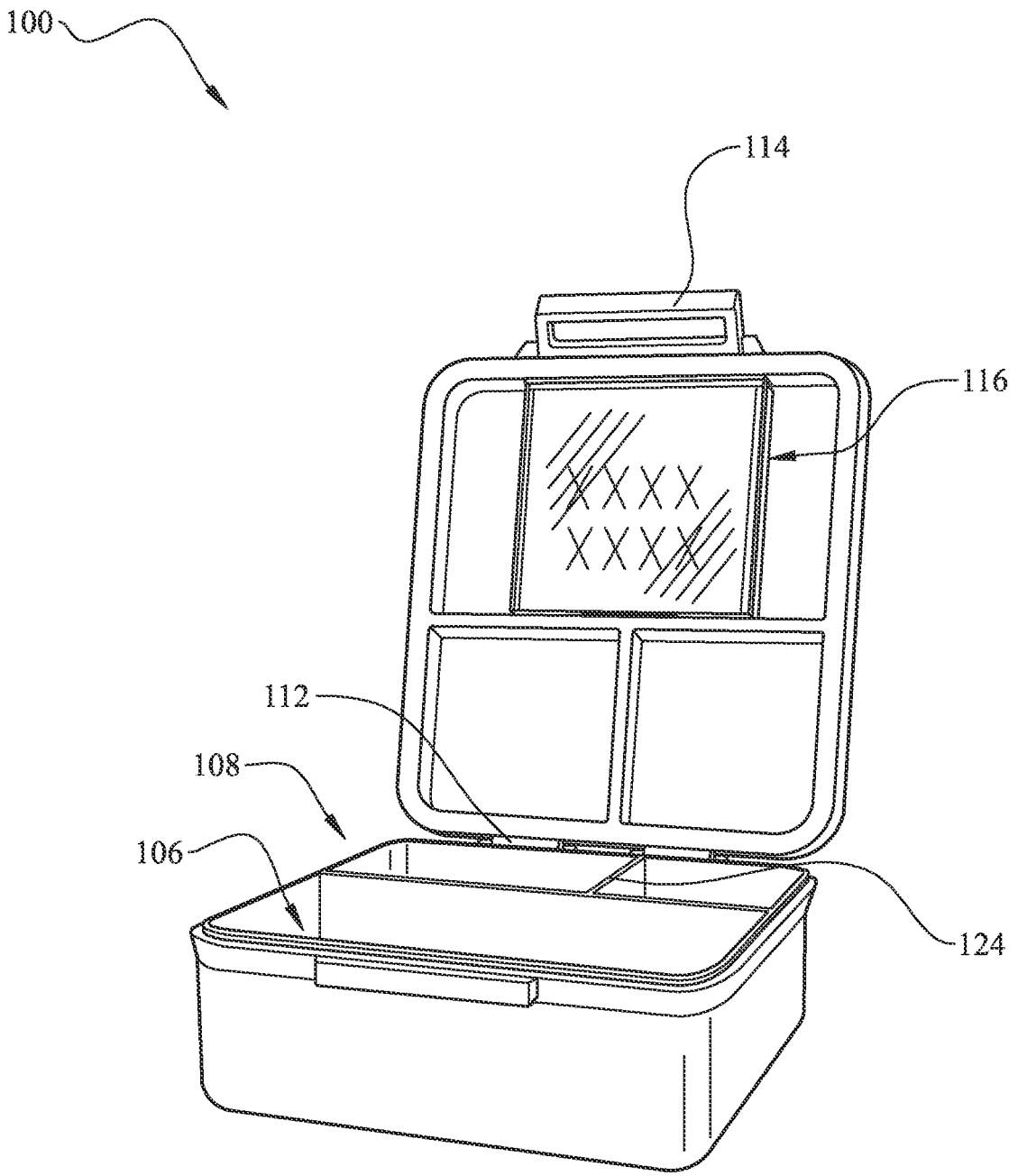
FIG. 2 presents an isometric perspective view of the lunch box assembly embodiment of FIG. 1 with the lunch box lid in an open configuration and showing an internal note storing case comprising a case lid, and a base with a dry erase back panel with writing on it.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1 Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

As used throughout the specification and claim(s), the term "dry erase back panel" includes any type of writing/drawing board regardless of its color or material/coating, including but not limited to painted metal, melamine, laminate, porcelain, magnetic, gel, LCD touch, etc., and regardless of the type of non-permanent writing tool employed such as but not limited to dry erase markers, washable crayons, stylus, fingers, etc.

To provide more detail in each paragraph of the detailed description, while using the same terminology as found in the claims generated, the following modifications are made:

In various embodiments, the meal transporting assembly, depicted in FIGS. 1-5, comprises a multifunctional container 100, fabricated from a diverse range of materials including, but not limited to, molded plastic, tin metal, treated wood, insulated polyester fabric, natural fibers, and woven bamboo. The container, designed for carrying food items, features a base portion 104 that houses a storage area 106 complete with an access opening 108. The base is equipped with compartment dividers 124, offering an efficient, bento-style organization for different food types. The container also includes a lid 110, hingeably attached to the base 104 using one or more hinges 112, which functions to securely open and close the access opening 108. Additionally, a securing means, such as a clasp 114, is integrated to maintain the container in a securely closed configuration as desired by the user.

In a preferred embodiment, the assembly includes an advanced storage unit 116, located within the container and designed to be resistant to environmental conditions, such as moisture. This internal waterproof case 116 is comprised of a base 117 forming an internal compartment 118, ideally suited for storing items like paper notes. The base of this storage unit is innovatively designed with a writable surface, specifically a dry erase back panel 120, offering a convenient space for writing non-permanent memos, inspirational thoughts, or for drawing/doodling.

The storage unit 116 further includes a closure element, namely a lid 122, hingeably coupled to its base 117. This lid is ingeniously designed to hermetically snap close and open, utilizing a fastening mechanism such as a snap fit joint or connector. In a preferred embodiment, the lid 122 is crafted from a transparent material, allowing users to easily view any notes or materials stored within the waterproof case 116.

Notably, the presence of the dry erase back panel 120 without the protective lid 122 could result in dry erase marker residue contaminating the food items, and the written messages being inadvertently erased.

Figure 3:
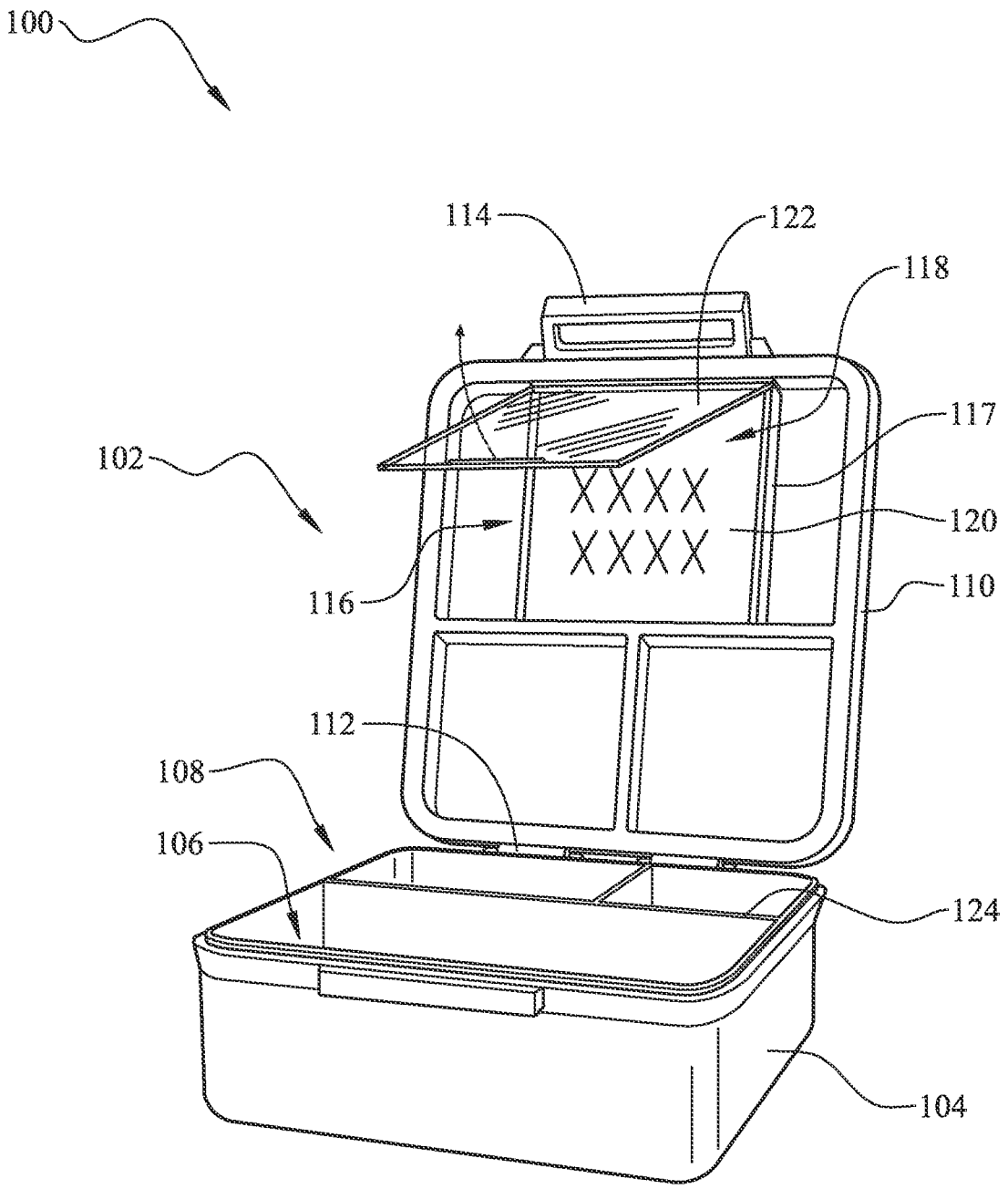
FIG. 3 presents an isometric perspective view of the lunch box assembly embodiment of FIG. 2 showing the internal note storing case in an open configuration and with writing on the dry erase back panel.
Figure 4:
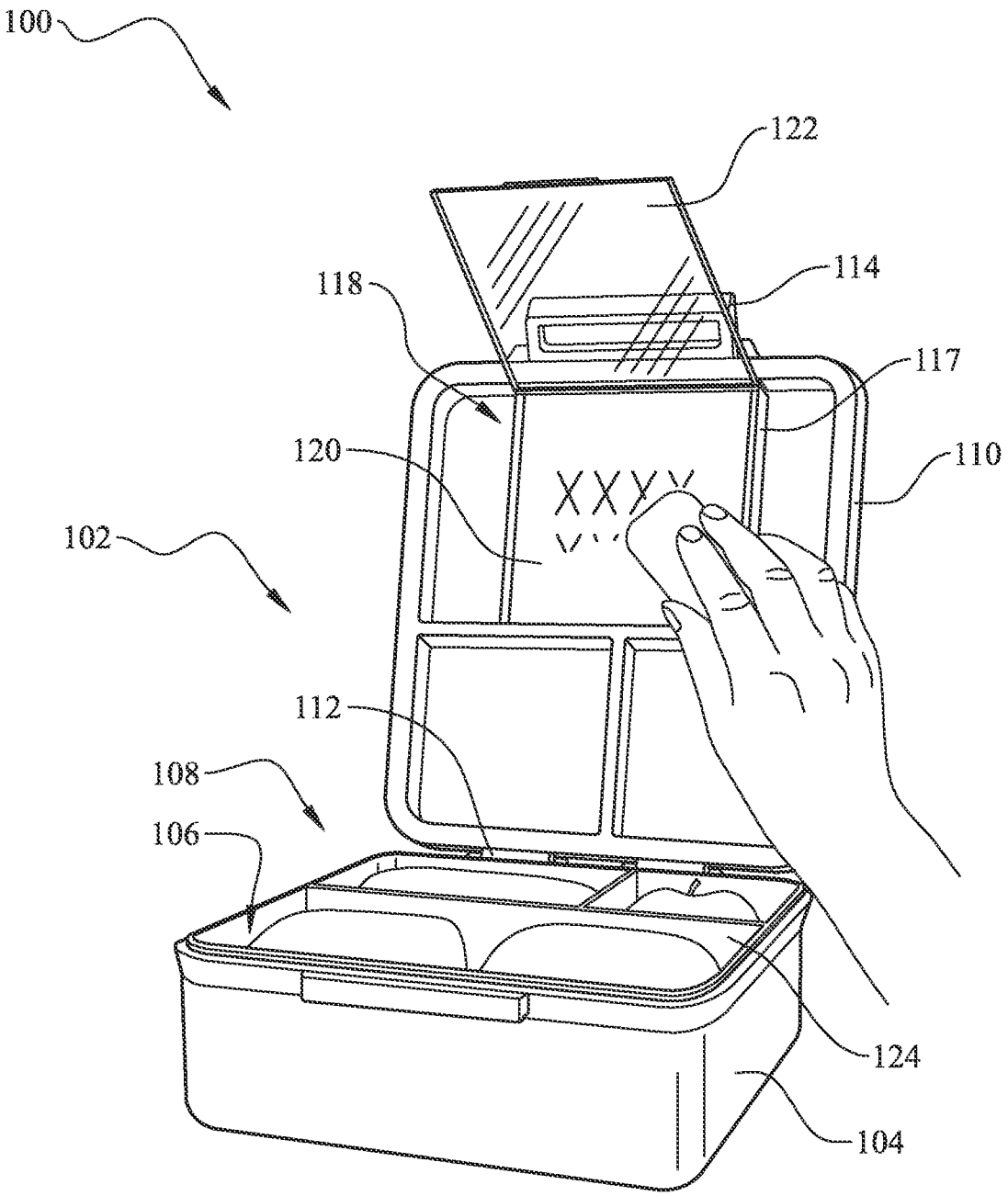
FIG. 4 presents an isometric perspective view of the lunch box assembly embodiment of FIG. 3 showing a user erasing the writing of the dry erase back panel.
Figure 5:
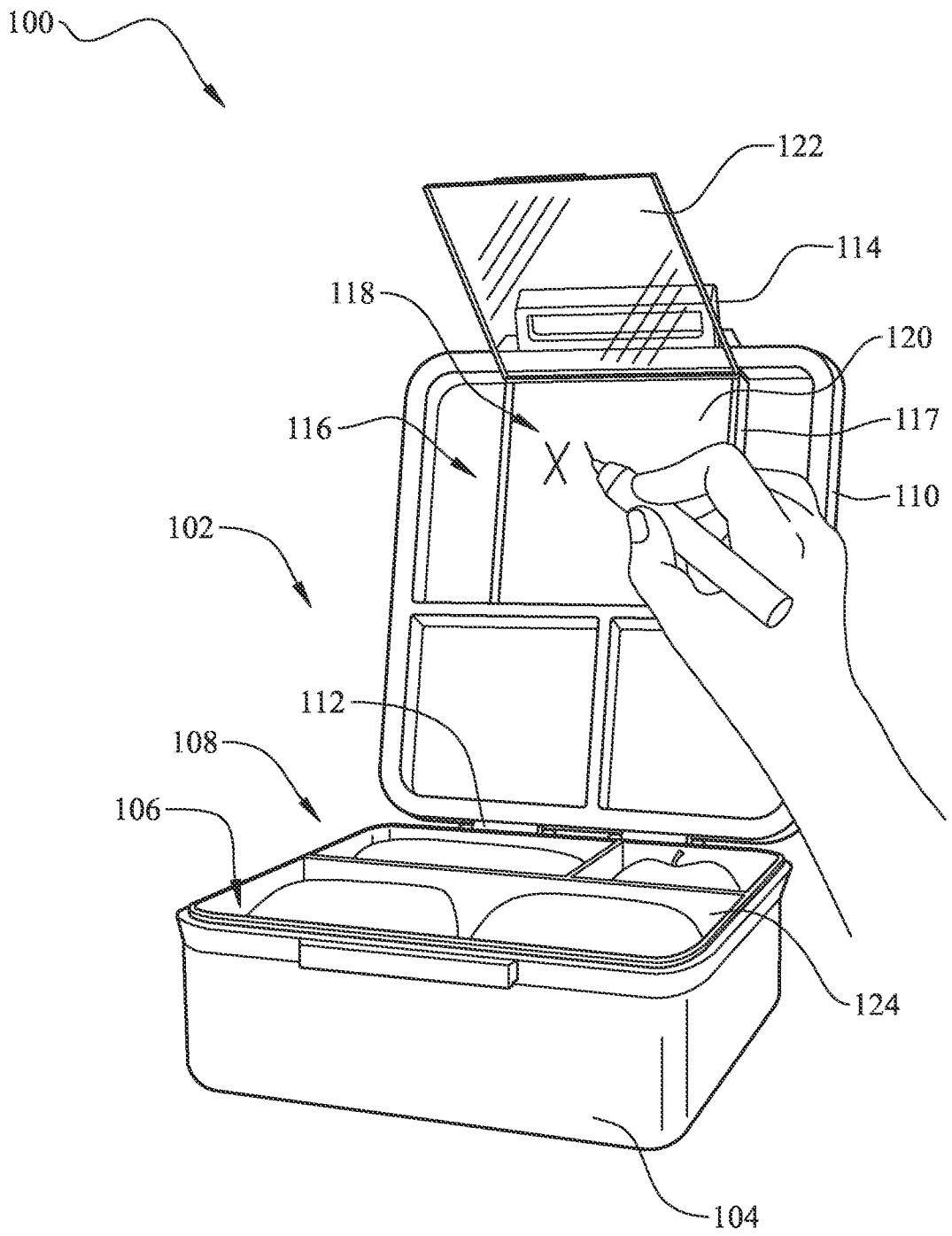
FIG. 5 presents an isometric perspective view of the lunch assembly embodiment of FIG. 4 showing the user writing on the dry erase back panel of the internal note storing case while the lid of the storing case is open.

Referring specifically to FIGS. 3-5, the internal waterproof case 116 can be positioned on the internal surface of the lid 110 of the container. Alternatively, in another embodiment, the waterproof case 116 can be located within the storage compartment 106 itself. In one configuration, the waterproof case 116 is permanently attached to the inside surface of the container's lid 110, while in another, it is designed to be removable and snaps into a designated place within the container, such as on the internal surface of the lid 110.

The strategic placement and orientation of the waterproof case 116 within the container 102 are such that it is immediately visible upon opening the container, and it is configured to ensure that there is no interference with the opening and closing of the container.

The dimensions and design of the lid 122 of the storage unit are carefully considered to allow comfortable writing on the dry erase back panel 120 without any hindrance when the lid is opened. For instance, the cavity 118 has a depth of only a few millimeters, sufficient to prevent the lid 122 from contacting the dry erase back panel 120 and adequately sized to accommodate items like paper sticky notes.

In a distinct embodiment, a retrofitting kit is provided, enabling users to modify existing lunch boxes to incorporate an internal waterproof case 116 for storing notes. This kit includes a waterproof case featuring a base and a hingeably attached lid, wherein the base forms a cavity and includes a dry erase back panel. The waterproof case in the kit is specifically designed to fit snugly inside a typical lunch box.

For attachment purposes, the back of the waterproof case in the kit is equipped with adhesive, allowing for permanent fixation inside a lunch box in a highly visible location upon opening the container's lid. The lid of the waterproof case in this kit is also transparent, aligning with the preferred embodiment of the invention.

Included in the kit are user instructions, guiding the placement of the waterproof case on the internal surface of the container's lid. This ensures that the case is affixed in an optimal position for visibility and accessibility.

The kit also comprises specially designed sticky paper notes, fitting perfectly inside the internal storing waterproof case. These notes are available in various bright colors and may feature pre-written positive notes, quotes, popular characters, sports team logos, and other engaging designs.

The non-limiting examples further illustrate the versatility and applicability of these embodiments. In a first example, a bento-style lunch box is constructed from molded plastic and incorporates an internal storing waterproof case for notes. The container features a base and a lid, connected via hinges to form an airtight compartment. Dividers in the compartment facilitate the storage of different types of food products in an organized manner. A foldable fastening clasp is included to secure the container in a closed configuration.

Within this assembly, an internal storing waterproof case for notes is placed on the internal surface of the lid. This case includes a transparent, hinged lid attached to a base, which houses a dry erase back panel accessible when the lid is opened. The orientation of this lid allows a user to write or draw on it without any obstruction, similar to how a car's trunk opens.

The internal waterproof case is designed with a rectangular shape, with dimensions smaller than the internal surface of the container's lid. Its minimal depth, just enough to fit paper notes and prevent contact with the dry erase back panel, ensures it fits within the container without impeding its functionality.

In testing, handwritten paper notes were placed inside this waterproof case along with cold food items in the container. Remarkably, despite the condensation from the food items, the notes remained dry, un-wrinkled, and easily visible.

In another second example, the container demonstrates the invention's reach to customers owning regular lunch boxes, by offering a kit for retrofitting these containers to include an internal storage case for notes. The kit comprises a thin, rectangular, transparent waterproof case, designed to store notes within a lunch box. The case's lid, capable of snapping open and closed, is hingeably attached to a base with a shallow depth.

The base of this waterproof case is adapted with a dry erase back panel, accessible when the lid is open. Adhesive on the back panel enables attachment of the waterproof storage case to the inside surface of a lunch box.

Included in the kit are user instructions, guiding the placement of the storage case on the internal surface of the lid for permanent attachment inside a lunch box. This positioning ensures easy visibility upon opening the container's lid.

Additionally, the kit includes sticky paper notes tailored to fit inside the internal storing waterproof case, along with a non-permanent dry erase marker compatible with the dry erase back panel.

These examples, along with their operating conditions, can be adapted and repeated with similar success, showcasing the flexibility and broad applicability of the invention.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A meal transporting assembly comprising:

a container suitable for carrying food items, including a base portion having a storage area for accommodating various items and an access opening;

a main lid mounted to the container, operable to move relative to the container to selectively open and close the access opening;

a storage unit disposed within a designated compartment of an internal surface of the main lid, the storage unit including, a base having a writable surface and an internal compartment for holding items such as notes or other materials;

a closure element mounted to the base, the closure element configured to move relative to the base between an open condition and a closed condition; and at least one of a snap fit or fastener structure configured to establish a seal between the closure element and the base when in the closed condition of the closure element to protect the internal compartment from external elements; and a clasp or fastener for securing the main lid in position to corresponding to closure of the container;

wherein placement and orientation of the storage unit within the container are configured to prevent interference with opening and closing of the main lid relative to the container.

2. The meal transporting assembly of claim 1, wherein the container is made from a material selected from the group consisting of molded plastic, tin metal, treated wood, insulated polyester fabric, natural fibers, and woven bamboo.

3. The meal transporting assembly of claim 1, wherein the base portion of the container further comprises compartment dividers to create subdivisions for different food types.

4. The meal transporting assembly of claim 1, wherein the closure element of the storage unit is hingeably coupled to the base of the storage unit and is configured to hermetically snap close and open.

5. The meal transporting assembly of claim 1, wherein the closure element of the storage unit is made from a transparent material.

6. The meal transporting assembly of claim 1, wherein the base of the storage unit comprises a writable surface forming a cavity for storing items such as paper notes.

7. The meal transporting assembly of claim 6, wherein the cavity has a depth sufficient to prevent the closure element from contacting the writable surface.

8. The meal transporting assembly of claim 1, further comprising a kit for retrofitting existing containers to include a storage unit similar to the storage unit of the meal transporting assembly.

9. The meal transporting assembly of claim 8, wherein the kit includes instructions for placement of the storage unit within the container.

10. The meal transporting assembly of claim 8, wherein the kit includes sticky paper notes that fit inside the internal compartment of the storage unit.

11. The meal transporting assembly of claim 10, wherein the sticky paper notes are of different bright colors and may include pre-written positive notes or quotes.

12. The meal transporting assembly of claim 8, wherein the storage unit includes adhesive on its back for permanent attachment inside the container.

13. The meal transporting assembly of claim 1, wherein the container includes a fastening mechanism to maintain the container in a closed configuration.

14. The meal transporting assembly of claim 1, wherein the container is constructed in a style with subdivisions for different types of food products.

15. The meal transporting assembly of claim 1, wherein the storage unit is dimensioned to fit within the container without affecting its opening/closing functions.

16. The meal transporting assembly of claim 1 wherein the storage unit is configured to be received within the designated compartment of the internal surface of the main lid in snapped relation therewith.

17. The meal transporting assembly of claim 16 wherein the storage unit is releasably mounted within the designated compartment of the main lid.

18. A meal transporting assembly comprising:

a container suitable for carrying food items, fabricated from a material selected from the group consisting of molded plastic, tin metal, treated wood, insulated polyester fabric, natural fibers, and woven bamboo;

a base portion of the container including compartment dividers to create subdivisions for different food types;

a main lid mounted to the base portion and operable to move relative to the base portion to selectively open and close the base portion and permit selective access to the subdivisions thereof;

a storage unit disposed within a corresponding recess of an internal surface of the main lid;

the storage unit including a base with a writable surface forming a cavity for storing items such as paper notes, where the base comprises a dry erase back panel;

the storage unit further comprising a transparent closure element, hingeably coupled to the base of the storage unit, configured to hermetically snap close and open to permit access to the cavity of the storage unit, and allowing visualization of the contents within the storage unit;

a securing member including a clasp or fastener for securing the main lid in position corresponding to closure of the container.

19. The meal transporting assembly of claim 18 wherein the storage unit is configured to be received within a designated compartment of the internal surface of the main lid in snapped relation therewith.

20. A meal transporting assembly comprising:

a container suitable for carrying food items, fabricated from a material selected from the group consisting of molded plastic, tin metal, treated wood, insulated polyester fabric, natural fibers, and woven bamboo, and featuring a foldable fastening clasp for secure closure;

a base portion of the container including bento-style compartment dividers for organizing different food types;

a storage unit located within the container, designed to be resistant to environmental conditions, such as moisture, removable, and configured to snap into a designated place within the container, with an adhesive back for permanent attachment in a highly visible location upon opening of a lid of the container;

the storage unit including a base with a writable surface, specifically a dry erase back panel, and forming a shallow cavity;

the storage unit further comprising a transparent closure element, hingeably coupled to the base of the storage unit, configured to hermetically snap close and open, and made from a material that facilitates easy viewing of any notes or materials stored within, the transparent closure element arranged relative to the shallow cavity of the base to avoid contact of the transparent closure element with the writable surface thereby allowing for storage of paper notes without interference;

wherein placement and orientation of the storage unit within the container is configured to prevent interference with opening and closing of the container; and wherein the meal transporting assembly further includes a kit with sticky paper notes of different bright colors and pre-written positive notes or quotes, fitting inside an internal compartment of the storage unit.

* * * * *